US009196128B2

(12) United States Patent
Sugai

(10) Patent No.: US 9,196,128 B2
(45) Date of Patent: Nov. 24, 2015

(54) GAME APPARATUS AND COMPUTER-READABLE RECORDING MEDIUM

(75) Inventor: Taiji Sugai, Tokyo (JP)

(73) Assignee: SEGA SAMMY CREATION INC., Tokyo (JP)

( * ) Notice: Subject to any disclaimer, the term of this patent is extended or adjusted under 35 U.S.C. 154(b) by 0 days.

(21) Appl. No.: 14/342,319

(22) PCT Filed: Aug. 21, 2012

(86) PCT No.: PCT/JP2012/071102

§ 371 (c)(1),
(2), (4) Date: Jun. 17, 2014

(87) PCT Pub. No.: WO2013/013585

PCT Pub. Date: Mar. 7, 2013

(65) Prior Publication Data

US 2014/0349730 A1 Nov. 27, 2014

(30) Foreign Application Priority Data

Sep. 1, 2011 (JP) ..... 2011-190917

(51) Int. Cl.
*G07F 17/32* (2006.01)
*A63F 3/06* (2006.01)

(52) U.S. Cl.
CPC ..... *G07F 17/3288* (2013.01); *G07F 17/329* (2013.01); *G07F 17/3258* (2013.01); *G07F 17/3267* (2013.01); *G07F 17/3276* (2013.01); *A63F 3/062* (2013.01); *A63F 3/0605* (2013.01); *A63F 3/0645* (2013.01)

(58) Field of Classification Search
CPC ..... G07F 17/3258; G07F 17/3267; G07F 17/3276; G07F 17/3288; G07F 17/329; G07F 17/42; A63F 3/0605; A63F 3/062; A63F 3/0645
USPC ..... 463/21, 22
See application file for complete search history.

(56) References Cited

U.S. PATENT DOCUMENTS

| | | | | |
|---|---|---|---|---|
| 6,688,597 | B2 * | 2/2004 | Jones | 273/274 |
| 6,776,712 | B2 | 8/2004 | Idaka | |
| 7,963,848 | B2 | 6/2011 | Yoshizawa | |
| 8,337,300 | B2 * | 12/2012 | Bowers et al. | 463/25 |
| 2008/0096642 | A1 | 4/2008 | Yoshizawa | |
| 2008/0176628 | A1 | 7/2008 | Okada | |
| 2011/0003635 | A1 | 1/2011 | Uchiyama et al. | |
| 2011/0212766 | A1 * | 9/2011 | Bowers et al. | 463/25 |

FOREIGN PATENT DOCUMENTS

| | | | | |
|---|---|---|---|---|
| JP | 01094879 A | * | 4/1989 | A63F 5/04 |
| JP | 2008-104570 A | | 5/2008 | |

(Continued)

*Primary Examiner* — Corbett B Coburn
(74) *Attorney, Agent, or Firm* — Drinker Biddle & Reath LLP

(57) ABSTRACT

A game apparatus accepts a bet by a player on a betting target from among multiple betting targets. For each target, odds indicating a winning allotment in a first game are set. A drawing is conducted for the first game. According to the result of the drawing, a game medium is paid out. A stake is calculated for a second game whose payout ratio is 1, taking into account, along with a number of bet game media, a difference between a position payout ratio, which serves as a winning allotment expectation value per unit of game media, for the betting target bet on by the player, and a set payout ratio.

11 Claims, 19 Drawing Sheets

(56) References Cited

FOREIGN PATENT DOCUMENTS

| | | | |
|---|---|---|---|
| JP | 2008-173479 | A | 7/2008 |
| JP | 2009-189802 | A | 8/2009 |
| JP | 4373476 | B2 | 11/2009 |
| JP | 2009-279348 | A | 12/2009 |
| JP | 2011-160985 | A | 8/2011 |
| KR | 2002-0024548 | A | 3/2002 |
| KR | 2008-0038422 | A | 5/2008 |

* cited by examiner

Fig. 3B

| BETTING TARGET | | NUMBER OF WINNING EVENTS | WINNING PROBABILITY | ODDS | POSITION PAYOUT RATIO |
|---|---|---|---|---|---|
| THREE DICE TOTAL | | | | | |
| 4 | | 3 | 1.39% | 50 | 69.44% |
| 5 | | 6 | 2.78% | 27 | 75.00% |
| 6 | | 10 | 4.63% | 16 | 74.07% |
| 7 | | 15 | 6.94% | 11 | 76.39% |
| 8 | | 21 | 9.72% | 8 | 77.78% |
| 9 | | 25 | 11.57% | 7 | 81.02% |
| 10 | | 27 | 12.50% | 6 | 75.00% |
| 11 | | 27 | 12.50% | 6 | 75.00% |
| 12 | | 25 | 11.57% | 7 | 81.02% |
| 13 | | 21 | 9.72% | 8 | 77.78% |
| 14 | | 15 | 6.94% | 11 | 76.39% |
| 15 | | 10 | 4.63% | 16 | 74.07% |
| 16 | | 6 | 2.78% | 27 | 75.00% |
| 17 | | 3 | 1.39% | 50 | 69.44% |
| HIGH&LOW BET | | | | | |
| Low | Low (3) | 1 | 0.46% | 2 | 87.50% |
| | Low (4-9) | 80 | 37.04% | | |
| | Low (10) | 27 | 12.50% | 1 | |
| High | High (11) | 27 | 12.50% | 1 | 87.50% |
| | High (12-17) | 80 | 37.04% | 2 | |
| | High (18) | 1 | 0.46% | | |
| SPECIFIC SINGLE | | | | | |
| SPECIFIC SINGLE | | 75 | 34.72% | 2 | 69.44% |
| SPECIFIC TRIPLE | | | | | |
| SPECIFIC TRIPLE | | 1 | 0.46% | 150 | 69.44% |

Fig. 3C

| GRADE | MAXIMUM VALUE |
|---|---|
| PARADiCE | 1500 |
| MEGA | 500 |
| BIG | 100 |
| MINI | - |

Fig. 3D

| GRADE | INITIAL VALUE | MAXIMUM VALUE |
|---|---|---|
| PARADiCE | 1500 | 100000 |
| MEGA | 500 | 1500 |
| BIG | 100 | 500 |
| MINI | 0 | 100 |

Fig. 3E

| NUMBER OF WINNING LINES | AGAINST JP MAGNIFICATION |
|---|---|
| 8 | 1.0 |
| 6 | 0.1 |
| 5 | 0.08 |
| 4 | 0.07 |
| 1～3 | 0.02 |

GAME APPARATUS AND COMPUTER-READABLE RECORDING MEDIUM

CROSS-REFERENCE TO RELATED APPLICATIONS

This application is the U.S. national phase of the International Patent Application No. PCT/JP2012/071102 filed Aug. 21, 2012, which claims the benefit of Japanese Patent Application No. 2011-190917 filed Sep. 1, 2011, the entire content of which is incorporated herein by reference.

FIELD

The invention relates to a method of controlling a game apparatus.

BACKGROUND

A game apparatus is known regarding which odds (a magnification as to in what multiples game media, such as bet medals, return as a winning allotment) are set for each of a plurality of betting targets, as in a dice game, etc. (see Patent Documents 1, 2, etc.). Patent Document 1 discloses that odds ranging from 1:1 to 180:1 are set for each of a plurality of betting targets according to the appearance probability of a betting target.

In the above-described game apparatus, the total number of game media paid back via allotment with respect to the total number of game media bet by a player is controlled as a payout (PO) ratio. An installer for game apparatuses specifies a payout ratio (set payout ratio) for each game apparatus or for each business, and sets the odds, etc., such that an actual payout ratio approaches a set payout ratio.

SUMMARY

In the case of a dice game using three dice, such game involves approximately 30 betting targets, which cover: a total value of the rolled numbers of the three dice; a rolled number of any of the three dice; and the same rolled numbers among the three dice. Thus, it has been troublesome for an operator to set the odds for all of the betting targets for each game apparatus.

Further, a player can expect the set payout ratio for an entire game apparatus in accordance with the odds sets for each betting target, and thus, a comparison can easily be made regarding the businesses which have good/poor allotments. This has been a problem from the viewpoint of attracting customers.

The invention has been proposed in light of the above-described conventional problems, and an object is to provide a game apparatus capable of having an actual payout ratio converge to a set payout ratio while fixing odds for a plurality of betting targets.

According to an embodiment, a game apparatus comprises: operation accepting means that accepts a bet by a player on a betting target among a plurality of betting targets for each of which odds indicating a winning allotment in a first game are set; drawing means that conducts a drawing for the first game; allotment means that pays out a game medium in accordance with a drawing result of the drawing means; storage means that holds a set payout ratio targeted by the game apparatus; stake calculation means that calculates a stake for a second game whose payout ratio is 1, taking into account, along with a number of bet game media, a difference between a position payout ratio, which serves as a winning allotment expectation value per unit of game media, for the betting target bet on by the player, and a set payout ratio held by the storage means; stake accumulation means that accumulates a stake calculated by the stake calculation means; and second game execution means that, if a predetermined condition is satisfied, executes the second game based on a stake accumulated in the stake accumulation means.

According to another embodiment, a computer readable recording medium has an executable program recorded therein which causes a computer configuring a game apparatus to implement: operation accepting means that accepts a bet by a player on a betting target among a plurality of betting targets for each of which odds indicating a winning allotment in a first game are set; drawing means that conducts a drawing for the first game; allotment means that pays out a game medium in accordance with a drawing result of the drawing means; storage means that holds a set payout ratio targeted by the game apparatus; stake calculation means that calculates a stake for a second game whose payout ratio is 1, taking into account, along with a number of bet game media, a difference between a position payout ratio, which serves as a winning allotment expectation value per unit of game media, for the betting target bet on by the player, and a set payout ratio held by the storage means; stake accumulation means that accumulates a stake calculated by the stake calculation means; and second game execution means that, if a predetermined condition is satisfied, executes the second game based on a stake accumulated in the stake accumulation means.

With the game apparatus according to embodiments of the invention, an actual payout ratio can be made to converge to a set payout ratio while odds for a plurality of betting targets are fixed, whereby the setting operations to be performed by an operator can be reduced, and further, a comparison can be prevented from being made by a player regarding the businesses which have good/poor allotments.

Further, a sub game executed concurrently with a main game can improve the enjoyability of the game, which keeps a player from becoming bored and through which longer game play can be expected.

BRIEF DESCRIPTION OF THE DRAWINGS

Other objects, features and advantages of the invention will become more apparent by reading the following detailed descriptions with reference to the attached drawings.

FIG. 3B is another diagram illustrating an example of control data according to an embodiment of the invention.

FIG. 3C is another diagram illustrating an example of control data according to an embodiment of the invention.

FIG. 3D is another diagram illustrating an example of control data according to an embodiment of the invention.

FIG. 3E is another diagram illustrating an example of control data according to an embodiment of the invention.

DETAILED DESCRIPTION

Preferred embodiments of the invention will hereinafter be described.

Figure 1:
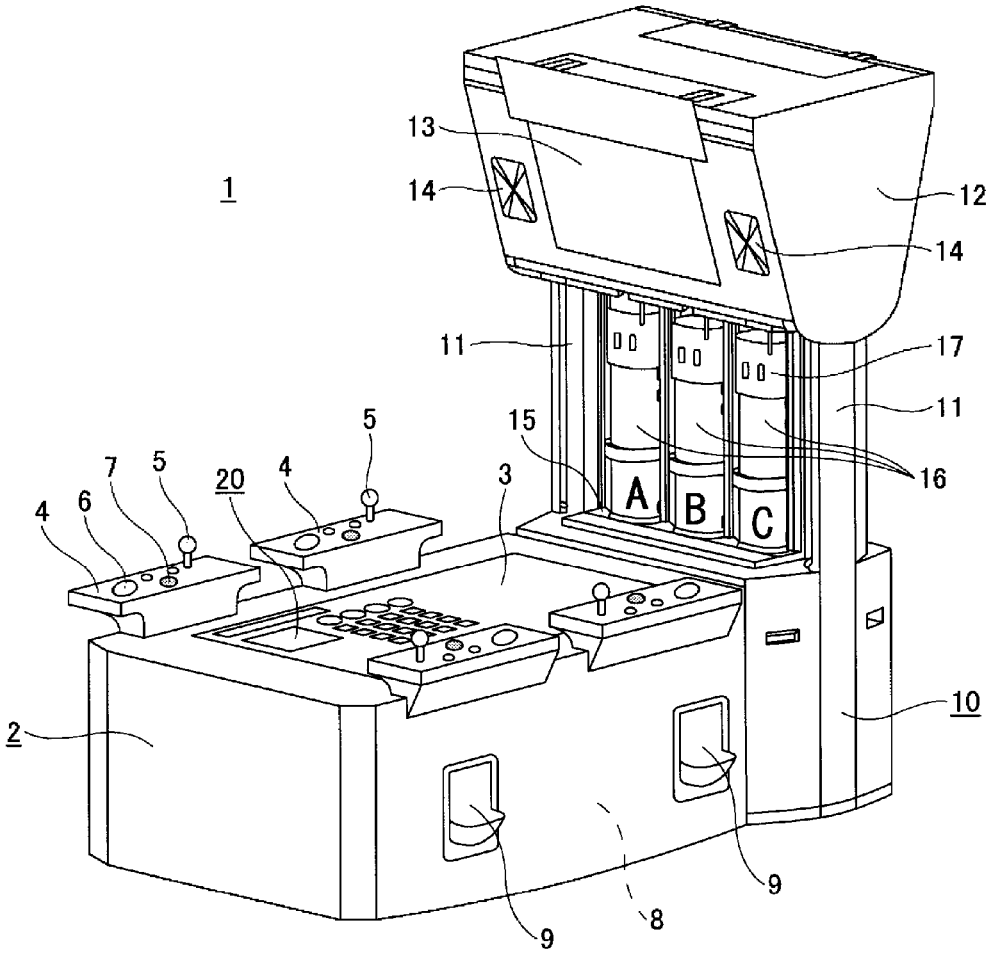
FIG. 1 is an outside perspective view of a game apparatus according to an embodiment of the invention.

FIG. 1 is an outside perspective view of a game apparatus 1 according to an embodiment of the invention. The game apparatus 1 will be described with the premise that a dice game, as a main game, and a bingo game, as a sub game, are employed; other games may also be applied as main and sub games.

In FIG. 1, the game apparatus 1 is constituted by a front-side operation casing 2 and a back-side dice upward-blowing casing 10. The dice upward-blowing casing 10 is provided with three upward-blowing pipes 16 located side by side.

In the game apparatus 16, a vertically long game table display 3 is provided on an upper surface of the operation casing 2. Four operation tables 4 are provided, protruding above an upper edge of the operation casing 2, so as to surround the game table display 3.

The operation tables 4 are respectively provided with: operators 5 each consisting of a lever and a plurality of buttons; and medal slots 6 into which medals are inserted. Operation table speakers 7 that emit sounds toward players for the operation tables 4 are respectively provided on upper surfaces of the operation tables 4. Further, medal outlets 9 that discharge medals from a metal discharge hopper 8, which is provided inside the operation casing 2, are provided below the operation tables 4, on either side surface of the operation casing 2.

The dice upward-blowing casing 10 is provided connected to the operation casing 2. The dice arranged inside the three upward-blowing pipes 16 are upward blown, from below and via air streams, and are then dropped, and the rolled numbers of such dice are then detected.

The dice upward-blowing casing 10 has a vertically long shape, and a ceiling 12 supported by columns 11 on both sides of the dice upward-blowing casing 10 is shaped such that each of a front surface and a back surface thereof is inclined downward. A history display 13, as a horizontally long liquid crystal display, is provided at the center of the ceiling 12, and upward-blowing casing speakers 14 are provided on both sides of the history display 13.

A horizontal base 15 is provided at the level of the midpoint of the dice upward-blowing casing 10, and this base 15 is mounted, at a left position A, a center position B, and a right position C, with the three transparent upward-blowing pipes 16, with respect to the ceiling 12.

A player can observe the state of the dice blown up and then dropped inside the upward-blowing pipes 16 and can also play a game, via operating the operator 5 of the operation table 4, by predicting the rolled numbers of the dice while viewing a game field 20 displayed on the game table display 3.

Figure 2:
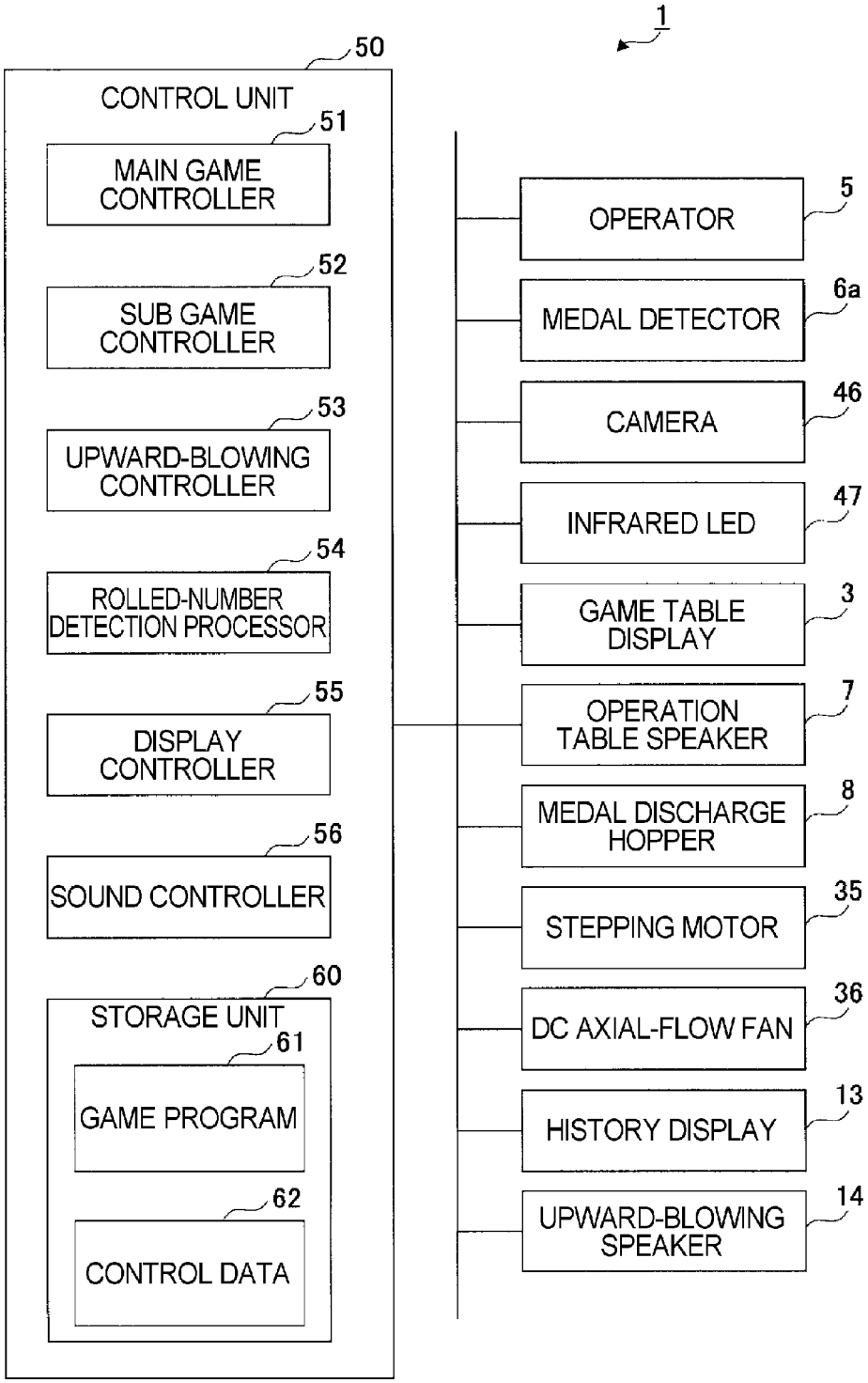
FIG. 2 is a block diagram illustrating a configuration example of a control system of the game apparatus according to an embodiment of the invention.

FIG. 2 is a block diagram illustrating a configuration example of a control system of the game apparatus 1.

Referring to FIG. 2, the game apparatus 1 is provided with a control unit 50, the game table display 3, the operators 5, a medal detector 6*a*, the operation table speakers 7, the medal discharge hoppers 8, the history display 13, the upward-blowing casing speakers 14, a stepping motor 35, a DC axial-flow fan 36, a camera 46 and an infrared LED 47. The game table display 3, the operators 5, the operation table speakers 7, the medal discharge hopper 8, the history display 13 and the upward-blowing casing speakers 14 are shown in FIG. 1. The medal detector 6*a* detects the insertion of medals into the medal slot 6 and the number of inserted medals.

The stepping motor 35 is used to open/close a shutter of an air intake located below each of the upward-blowing pipes 16.

The DC axial-flow fan 36 is used to generate air streams via the shutter of the air intake located below the upward-blowing pipe 16.

The camera 46 is used to photograph the motion of the dice from below in the upward-blowing pipes 16. Rolled numbers are detected from the photographed images of the rolled numbers of the dice that have dropped into the lower parts of the upward-blowing pipes 16, and the rolled numbers on the upper surfaces of such dice can be detected according to a rule whereby the sum of the rolled numbers of opposing surfaces of a dice is "7."

The infrared LED is used to illuminate dice so that they can be photographed by the camera 46.

The control unit 50 comprises a CPU (Central Processing Unit), memories (RAM (Random Access Memory) and ROM (Read Only Memory)), etc. The control unit 50 includes a storage unit 60 and achieves various functions by executing a game program 61 stored in the storage unit 60 so as to control the entire game apparatus 1. For example, the game program 61 may be recorded in a hard disk device (HDD) (recording medium) in the storage unit 60. Examples of such functions attained by the control unit 50 include a main game controller 51, a sub game controller 52, an upward-blowing controller 53, a rolled-number detection processor 54, a display controller 55 and a sound controller 56. The storage unit 60 stores the game program 61, control data 62, etc.

The main game controller 51 is a part that controls a dice game serving as a main game.

The sub game controller 52 is a part that controls a bingo game serving as a sub game.

The upward-blowing controller 53, being a part that controls the upward blowing of the dice, controls the stepping motor 35, the DC axial-flow fan 36, etc.

The rolled-number detection processor 54, being a part that detects the rolled numbers of the dice, controls the camera 46, the infrared LED 47, etc.

The display controller 55 controls the game table display 3, the history display 13, etc.

The sound controller 56 controls the operation table speakers 7, the upward-blowing casing speakers 14, etc.

FIGS. 3A, 3B, 3C, 3D and 3E are diagrams illustrating examples of the control data 62 held in the storage unit 60.

Figure 3A:
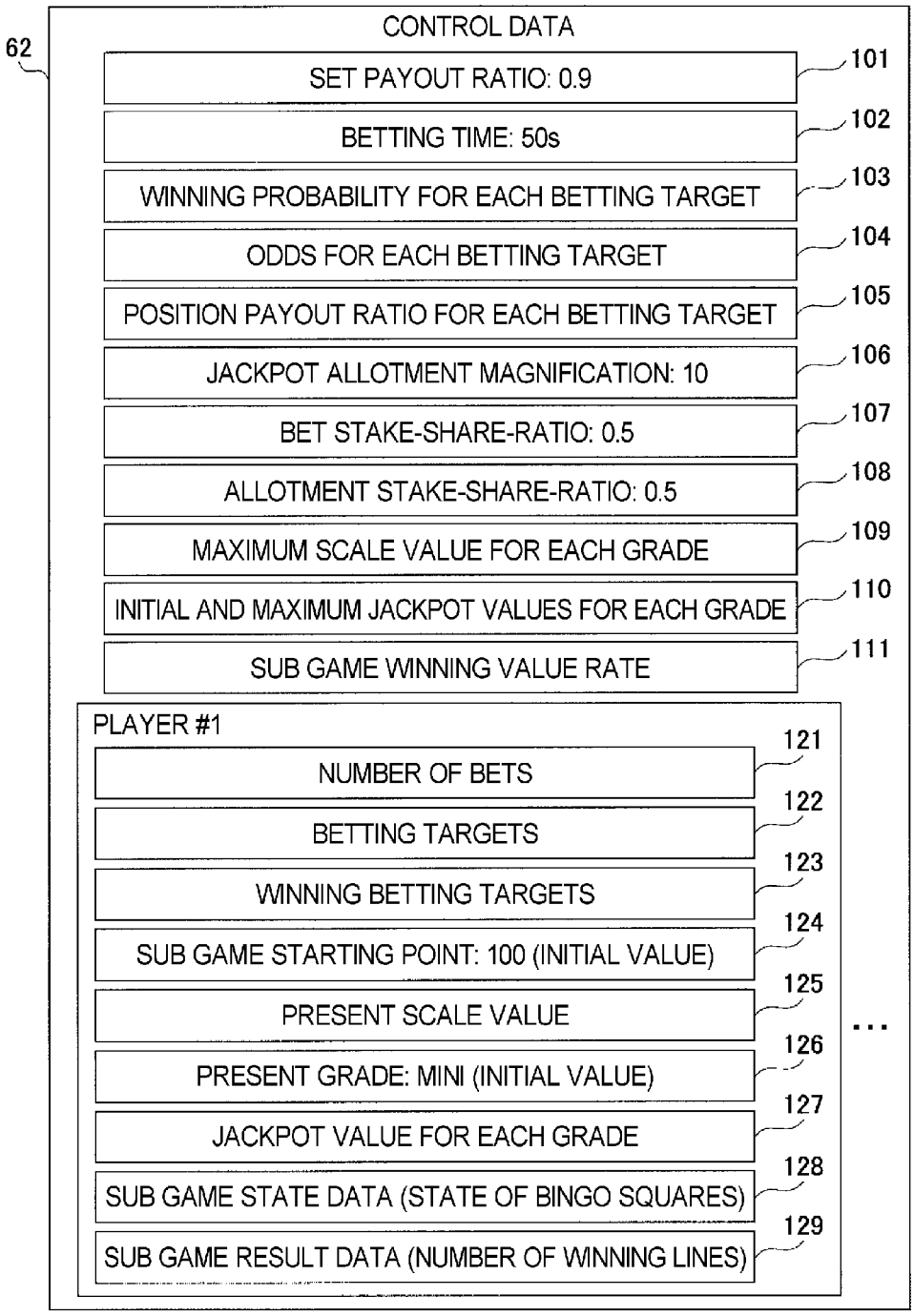
FIG. 3A is a diagram illustrating an example of control data according to an embodiment of the invention.

Referring to FIG. 3A, the control data 62 contains data common to all players and data for each player.

As to data common to all players, the control data 62 contains a set payout ratio 101, a betting time 102, a winning probability 103 for each betting target, odds 104 for each betting target, a position payout ratio 105 for each betting target, a jackpot allotment magnification 106, a bet stake-share-ratio 107, an allotment stake-share-ratio 108, a maximum scale value 109 for each grade, initial and maximum jackpot values 110 for each grade and a sub game winning value rate 111.

As to data for each player, the control data 62 contains a number of bets 121, betting targets 122, winning betting targets 123, a sub game startup point 124, a present scale value 125, a present grade 126, a jackpot value 127 for each grade, sub game status data 128 and sub game result data 129.

The meanings of such respective data pieces are described below.

The set payout ratio 101 refers to a payout ratio targeted by the game apparatus 1. "0.9 (90%)" is set, by way of example.

The betting time 102 refers to a time during which bets are accepted from the start of a new game, in a dice game serving as a main game. "50 s" is set, by way of example.

Referring to FIG. 3B, the winning probability 103 for each betting target refers to a winning probability corresponding to a betting target (e.g., "4," "5," "6," "7," "8," "9," "10," "11," "12," "13," "14," "15," "16," or "17" as the total of the rolled numbers of three dice; "Low" ranging from 3 to 10 as the total of the rolled numbers of three dice; "High" ranging from 11 to 18; "1," "2," "3," "4," "5," or "6" as one of the rolled numbers of the three dice; or "1," "2," "3," "4," "5," or "6" as the same rolled number shared by all three of the dice). A winning probability is obtained by dividing the number of winning events for a betting target by the number all of the events (the number of all of the combinations of rolled numbers for three dice is $6^3$=216), and thus, such winning probability may be obtained by calculation each time, or the relevant table may be made to be retained in advance.

Referring to FIG. 3B, the odds 104 for each betting target refer to odds corresponding to a betting target (a magnification as to in what multiples game media, such as bet medals, return as a winning allotment), and have a fixed round-number value settled as determined in advance by a designer in consideration of a winning probability and a set payout ratio. Therefore, an operator of the game apparatus 1 does not need to change such odds. In principle, odds are set such that a position payout ratio has a value lower than that of a set payout ratio. Further, in the example shown in the figure, regarding the betting target "Low," odds are set for each of: the case in which the total of the rolled numbers of the three dice ranges from 3 to 9; and the case in which such total is 10, and either of such odds is applied according to a drawing result. Similarly, regarding the betting target "High," odds are set for each of: the case in which the total of the rolled numbers of the three dice is 11; and the case in which such total ranges from 12 to 18, and either of such odds is applied according to a drawing result.

Referring to FIG. 3B, the position payout ratio 105 for each betting target refers to an allotment expectation value per unit number of game media such as medals (for example, one medal) when a betting target wins, and is obtained by multiplying a winning probability by the odds. The position payout ratio 105 may be calculated each time, or the relevant table may be made to be retained in advance. In the illustrated example, multiple winning probabilities and multiple odds are set for each of the betting targets "Low" and "High," and thus, a position payout ratio is calculated by performing an addition of the respective products of such winning probabilities and such odds regarding the respective patterns. That is, regarding the betting target "Low,"

0.46%×2+37.04%×2+12.50%×1=87.50% is obtained, and regarding the betting target "High,"

12.50%×1+37.04%×2+0.46%×2=87.50% is obtained.

The jackpot allotment magnification 106 refers to a magnification as to in what multiples the number of game media, such as medals, serving as a stake, are provided as an allotment when a jackpot (big win) occurs in a bingo game serving as a sub game. "10" is set, by way of example.

The bet stake-share-ratio 107 refers to a share ratio with respect to a bingo game serving as a sub game when, bets are made in a dice game serving as a main game, a stake proportional to the difference between a set payout ratio and a position payout ratio is collected. "0.5" is set, by way of example.

The allotment stake-share-ratio 108 refers to a share ratio with respect to a bingo game serving as a sub game when, an allotment is provided in a dice game serving as a main game, a stake proportional to the difference between a set payout ratio and a position payout ratio is collected. "0.5" is set, by way of example. The sum of the bet stake-share-ratio 107 and the allotment stake-share-ratio 108 is assumed to be "1.0."

Referring to FIG. 3C, the maximum scale value 109 for each grade refers to the maximum scale value corresponding to each of the grades of a grade meter that shows a stake accumulation state of a bingo game serving as a sub game. The grade meter's grades consist of, for example, four divisions: "MINI," "BIG," "MEGA" and "PARADiCE" in order, starting from the lowest. In the initial state, the scale value of the lowest grade "MINI" is full, and the present grade is "MINI." When stake sharing is performed, the length of the gauge (bar) extends with the increase of the scale value in the next grade, "BIG." Then, when the scale value reaches the maximum "100" corresponding to the "BIG" grade, the present grade then becomes "BIG." Similarly, grade changes up to the highest grade of "PARADiCE" can be effected in accordance with the increase in the scale value.

Referring to FIG. 3D, the initial and maximum jackpot values 110 for each grade refer to initial and maximum jackpot values corresponding to each of the grades of a grade meter.

Referring to FIG. 3E, the sub game winning value rate 111 refers to a rate for a winning value of a bingo game serving as a sub game, and specifies a magnification with respect to the jackpot (JP) value of the present grade, in accordance with the number of winning lines attained in a bingo game. When all of the lines win (in the case of a bingo game with 3×3=9 squares, this means that eight lines win), a jackpot occurs, and an allotment is provided based on the jackpot value itself. A smaller number of winning lines results in a smaller allotment.

The number of bets 121 refers to the number of game media, such as medals, bet by a relevant player on the betting targets 122 in a dice game serving as a main game.

The betting targets 122 refer to betting targets bet on by a relevant player in a dice game serving as a main game and comprise data held based on a determination made by the main game controller 51 in accordance with signals from the operator 5.

The winning betting targets 123 refer to betting targets that win as a result of a drawing in a dice game serving as a main game and comprise data held based on a determination made by the main game controller 51 as to the rolled numbers of dice.

The sub game startup point 124 refers to data for determining a start of a bingo game serving as a sub game. For example, the sub game startup point 124 starts to be reduced from the initial value "100," and a bingo game is started when "0" is reached. The process of controlling the value of the sub game startup point 124 will be described below.

The present scale value 125 refers to the scale value, as of a present moment, of a grade meter. The process of controlling the value of the present scale value 125 will be described below.

The present grade 126 refers to the grade, as of a present moment, of a grade meter. The initial value is "MINI." The process of controlling the value of the present grade 126 will be described below.

The jackpot value 127 for each grade refers to a jackpot value set for each of the grades of a grade meter. The process of controlling the value of the jackpot value 127 for each grade will be described below.

The sub game status data 128 refers to data showing the state of a bingo game managed by the sub game controller 52, and contains: data on the rolled numbers of a die randomly assigned to each of the squares (e.g., 3×3=9 squares) (for each square, either one rolled number may be employed, or multiple rolled numbers—regarding which it is sufficient for any one of such numbers to produce a match—may be employed); and data indicating that any of the squares has become a line component for a win (in general, an "occupied" or "open" state) due to the match of the rolled number of such square with a rolled number in a dice game serving as a main game.

The sub game result data 129 refers to data indicating the result of a bingo game managed by the sub game controller 52, and contains the number of winning lines (in the case of 3×3=9 squares, this is constituted by each case of three squares located vertically, horizontally or diagonally in a continuous manner) etc.

Figure 4:
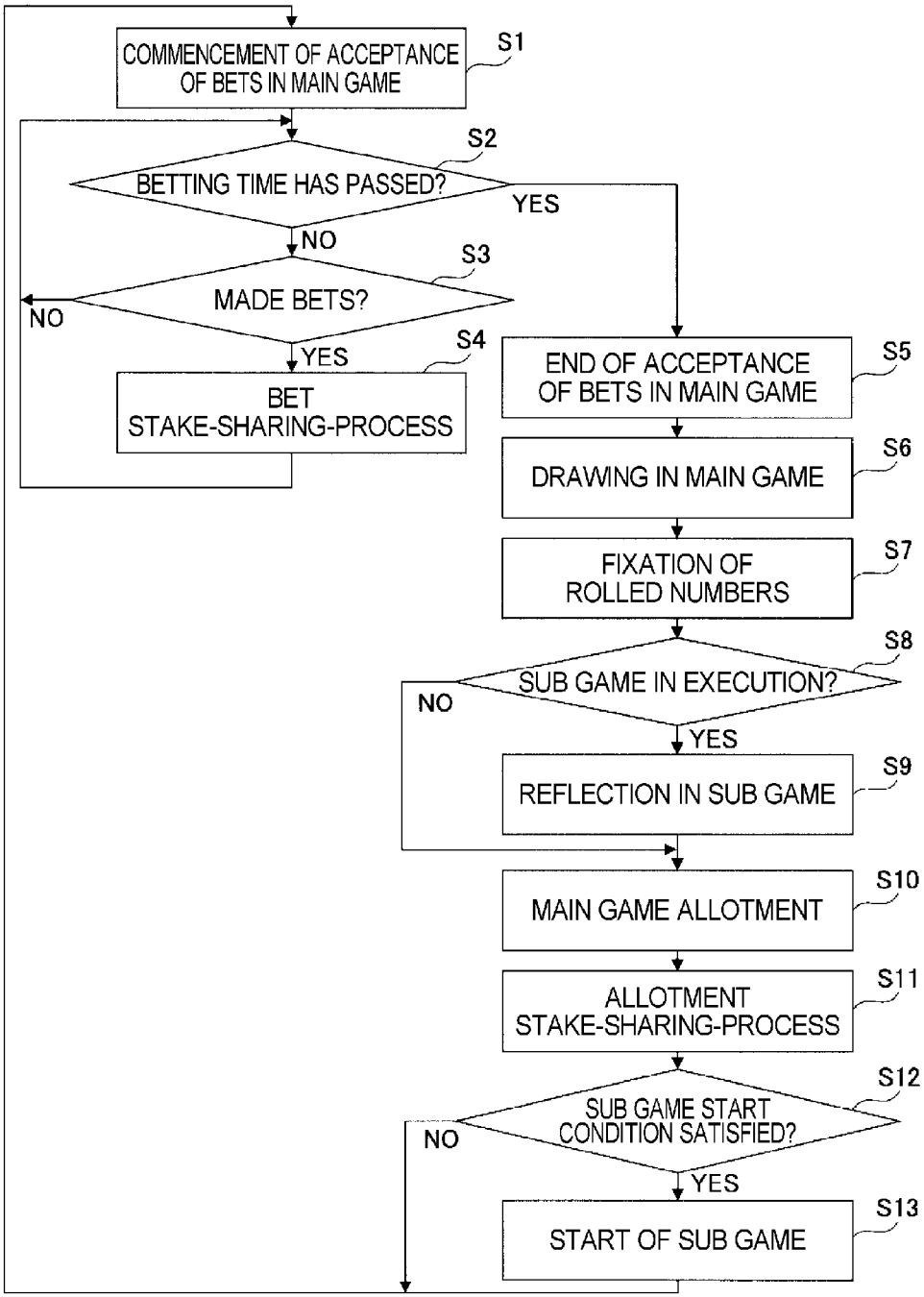
FIG. 4 is a flowchart illustrating a process example of the embodiment of the invention.

FIG. 4 is a flowchart showing a process example of the embodiment above.

Figure 5:
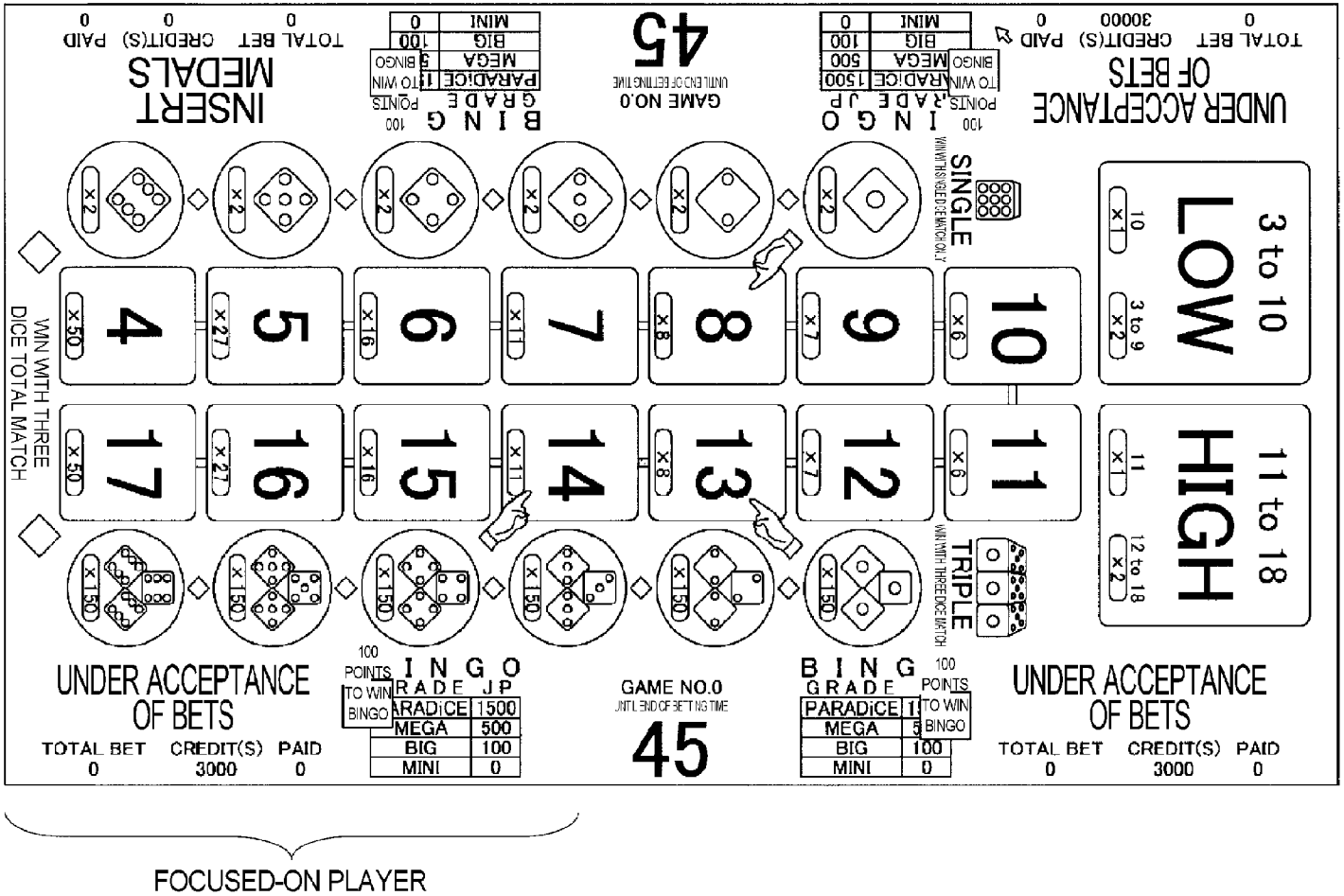
FIG. 5 is a diagram illustrating an example of a display screen of a game table display according to an embodiment of the invention.

In FIG. 4, firstly in step S1, the main game controller 51 commences the acceptance of bets in a main game. FIG. 5 shows an example of a display screen during the acceptance of bets in the game table display 3. In the center of the screen, a plurality of betting targets is displayed together with odds, and the areas of players are respectively displayed at the upper and lower ends of the screen, on the left and right. Further, a remaining time during which bets can be accepted is displayed between the player's areas on both sides of the screen in the longitudinal direction.

Returning to FIG. 4, in step S2, the main game controller 51 determines whether or not the time specified as the betting time 102 (FIG. 3A) has passed after commencement of the acceptance of bets.

If such specified time has not passed (NO in step S2), in step S3, the main game controller 51 determines whether or not a player has made bets.

If the main game controller 51 determines that no bet has been made (NO in step S3), it returns to a determination on the passage of a betting time (step S2).

If the main game controller 51 determines that a bet has been made (YES in step S3), in step S4, the sub game controller 52 performs a stake sharing process for each player that has made a bet. It is assumed here that the sub game controller 52 performs a stake sharing process from the viewpoint that such process is for a sub game; the main game controller 51 may perform such stake sharing process.

A bet stake-sharing-process is performed according to the following procedure.

(a) A winning stake per bet is calculated by:

(set payout ratio−position payout ratio)×bet stake-share-ratio. A set payout ratio is acquired from the set payout ratio 101 (FIG. 3A). A position payout ratio is acquired from the position payout ratio 105 for each betting target (FIG. 3B) based on the betting target (FIG. 3A). A bet stake-share-ratio is acquired from the bet stake-share-ratio 107 (FIG. 3A). In principle, a position payout ratio is set so as to have a value smaller than that of a set payout ratio, and thus, the value of the above expression will be positive. Exceptionally, when a position payout ratio has a value greater than that of a set payout ratio, "0" is employed for the value of the above expression.

(b) A necessary stake for a one-scale-value increase of a grade meter is calculated by:

1/jackpot allotment magnification. A jackpot allotment magnification is acquired from the jackpot allotment magnification 106 (FIG. 3A).

(c) A grade meter increase probability is calculated by:

winning stake per bet/necessary stake for a one-scale-value increase of a grade meter.

(d) A random drawing is performed the number of times corresponding to the number of bets based on the calculated grade meter increase probability (a drawing whose winning probability is set so as to be equal to the grade meter increase probability). The number of bets is acquired from the number of bets 121 (FIG. 3A).

(e) For each of the random drawings repeated the above number of times corresponding to the number of bets, the scale value of a grade meter (the present scale value 125 in FIG. 3A) is increased by one in the case of a win. With such increase of the scale value of a grade meter, the bar extends in the grade, and when the next grade is reached, the present grade (the present grade 126 in FIG. 3A) is changed (updated).

Figure 6:
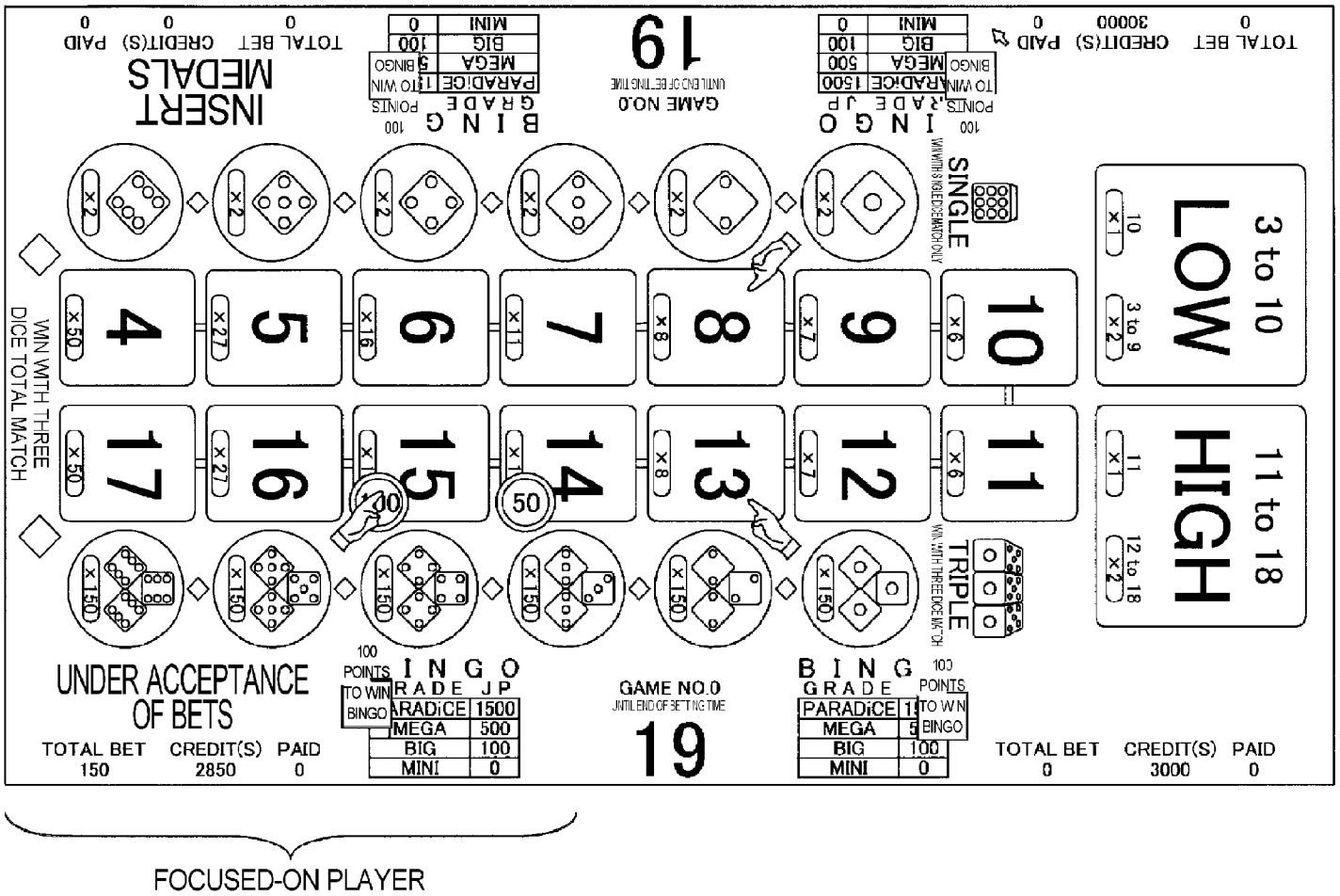
FIG. 6 is a diagram illustrating another example of a display screen of the game table display according to an embodiment of the invention.

FIG. 6 shows an example of a display screen in a state in which: the bets made by the lower left (focused-on) player (in the screen's lateral position) have caused the present grade to change from "MINI" to "BIG"; and the "MEGA" bar has then started to extend.

Referring back to FIG. 4, after the bet stake-sharing-process (step S4), the process returns to the determination on the passage of a betting time (step S2).

If the main game controller 51 determines that a betting time has passed after commencement of the acceptance of bets (YES in step S2), in step S5, the main game controller 51 terminates the acceptance of bets in the main game.

Figure 7:
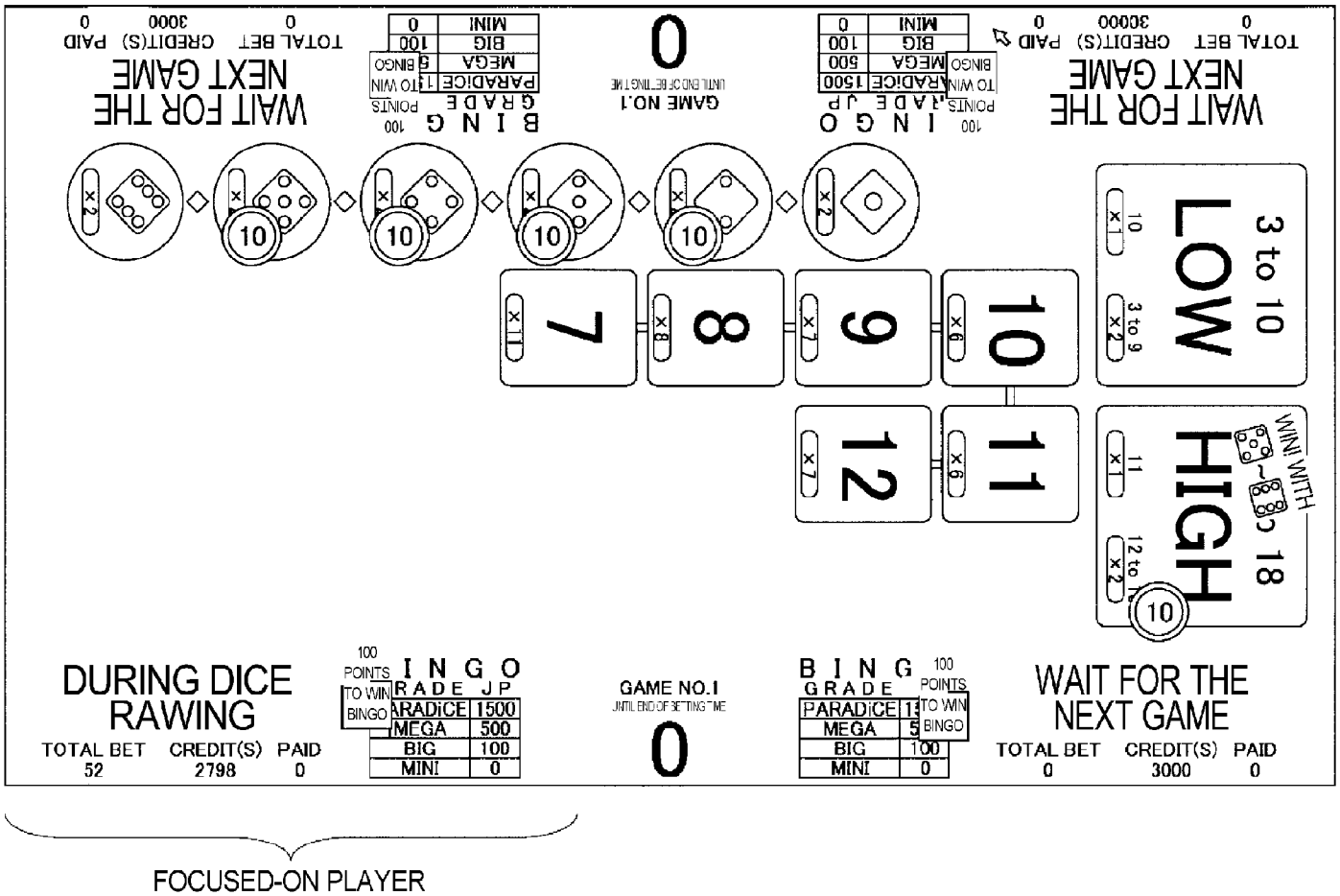
FIG. 7 is a diagram illustrating another example of a display screen of the game table display according to an embodiment of the invention.

Next, in step S6, the main game controller 51 performs a drawing for a dice game serving as the main game. That is, three dice are blown up and are then dropped. FIG. 7 shows an example of a display screen during a drawing. On the display screen, "During Dice drawing" is displayed in the area of the player who has made bets while "Wait for Next Game" is displayed in each of the areas of the players who have not made any bets.

Then, referring back to FIG. 4, when, in step S7, the rolled numbers of the dice are fixed, in step S8, the main game controller 51 then determines whether or not a sub game is in execution. Explanation is continued here assuming that a sub game is not in execution.

Figure 8:
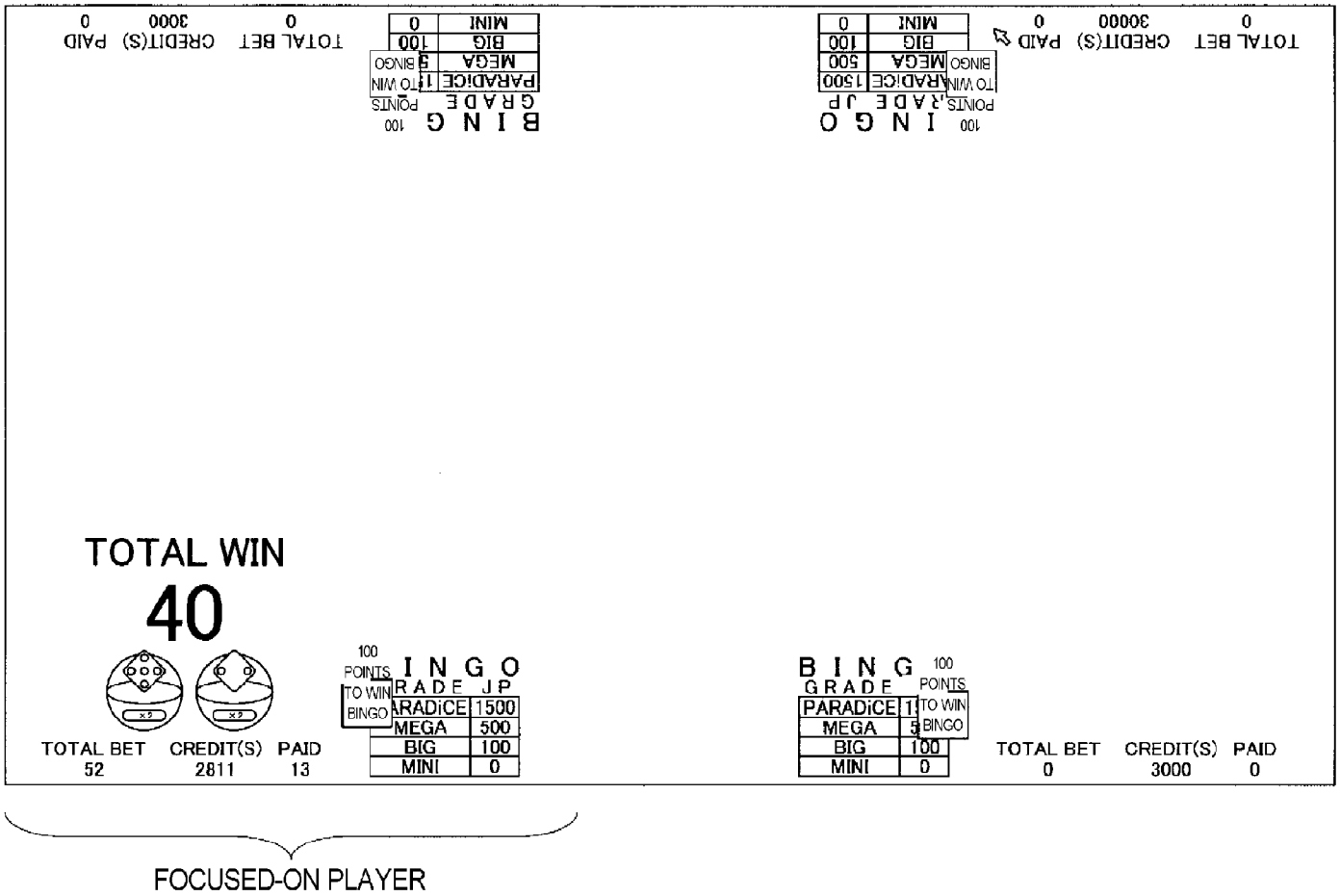
FIG. 8 is a diagram illustrating another example of a display screen of the game table display according to an embodiment of the invention.

If it is determined that a sub game is not in execution (NO in step S8), in step S10, regarding the main game, the main game controller 51 provides an allotment in accordance with rolled numbers. That is, if a betting target wins, an allotment obtained by multiplying the odds set for such betting target by the number of bets is paid out. FIG. 8 shows an example of a display screen in a state in which an allotment of "40" has been provided to the lower left player.

Next, referring back to FIG. 4, in step S11, the sub game controller 52 performs an allotment stake-sharing-process for each player. It is assumed here that the sub game controller 52 performs such stake sharing process from the viewpoint that such process is for a sub game; the main game controller 51 may also perform such process.

An allotment stake-sharing-process is performed according to the following procedure.

(a) A winning stake per bet is calculated by:

((set payout ratio−position payout ratio)/winning probability)×allotment stake-share-ratio. A set payout ratio is acquired from the set payout ratio 101 (FIG. 3A). A position payout ratio is acquired from the position payout ratio 105 for each betting target (FIG. 3B) based on the winning betting targets 123 (FIG. 3A). A winning probability is acquired from the winning probability 103 for each betting target (FIG. 3B) based on the winning betting targets 123 (FIG. 3A). An allotment stake-share-ratio is acquired from the allotment stake-share-ratio 108 (FIG. 3A). In principle, a position payout ratio is set so as to have a value smaller than that of a set payout ratio, and thus, the value of the above expression will be positive. Exceptionally, when a position payout ratio has a value greater than that of a set payout ratio, "0" is employed for the value of the above expression.

(b) A necessary stake is acquired by:

1/jackpot allotment magnification. A jackpot allotment magnification is acquired from the jackpot allotment magnification 106 (FIG. 3A).

(c) A winning jackpot value is calculated by:

winning stake/necessary stake.

Figure 9:
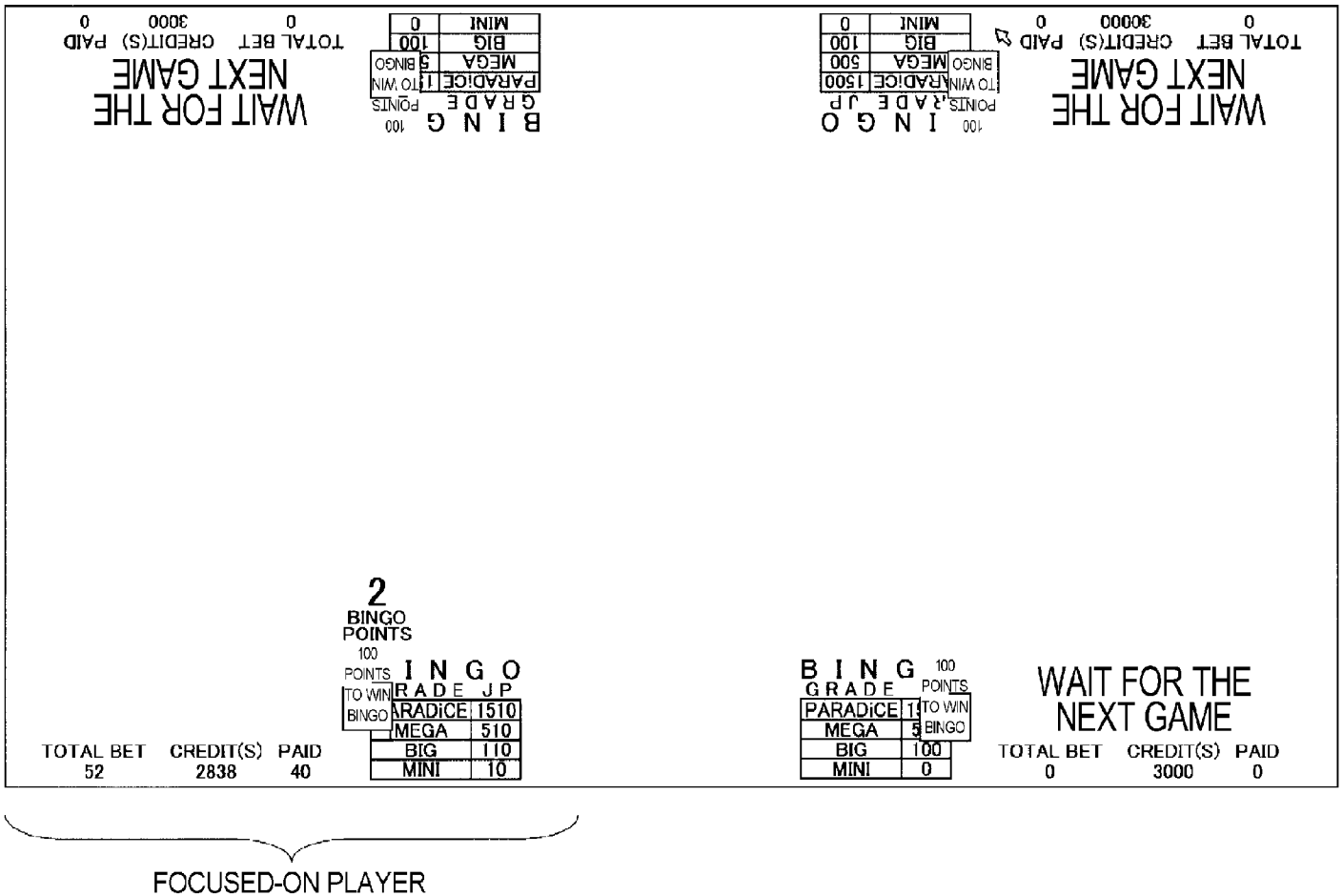
FIG. 9 is a diagram illustrating another example of a display screen of the game table display according to an embodiment of the invention.

(d) Regarding all of the grades, the calculated winning jackpot value is added to the jackpot value 127 for each grade (FIG. 3A). FIG. 9 shows an example of a display screen in a state in which, regarding the lower left player, the addition of "10" has been performed to each of the jackpot values of the four grades of the grade meter. It should be noted that, due to the maximum values specified by the initial and maximum jackpot values 110 for each grade (FIG. 3D), when such addition of a jackpot value results in an excess over the maximum values, such excess is retained internally and carried over to the start of the next sub game.

Figure 10:
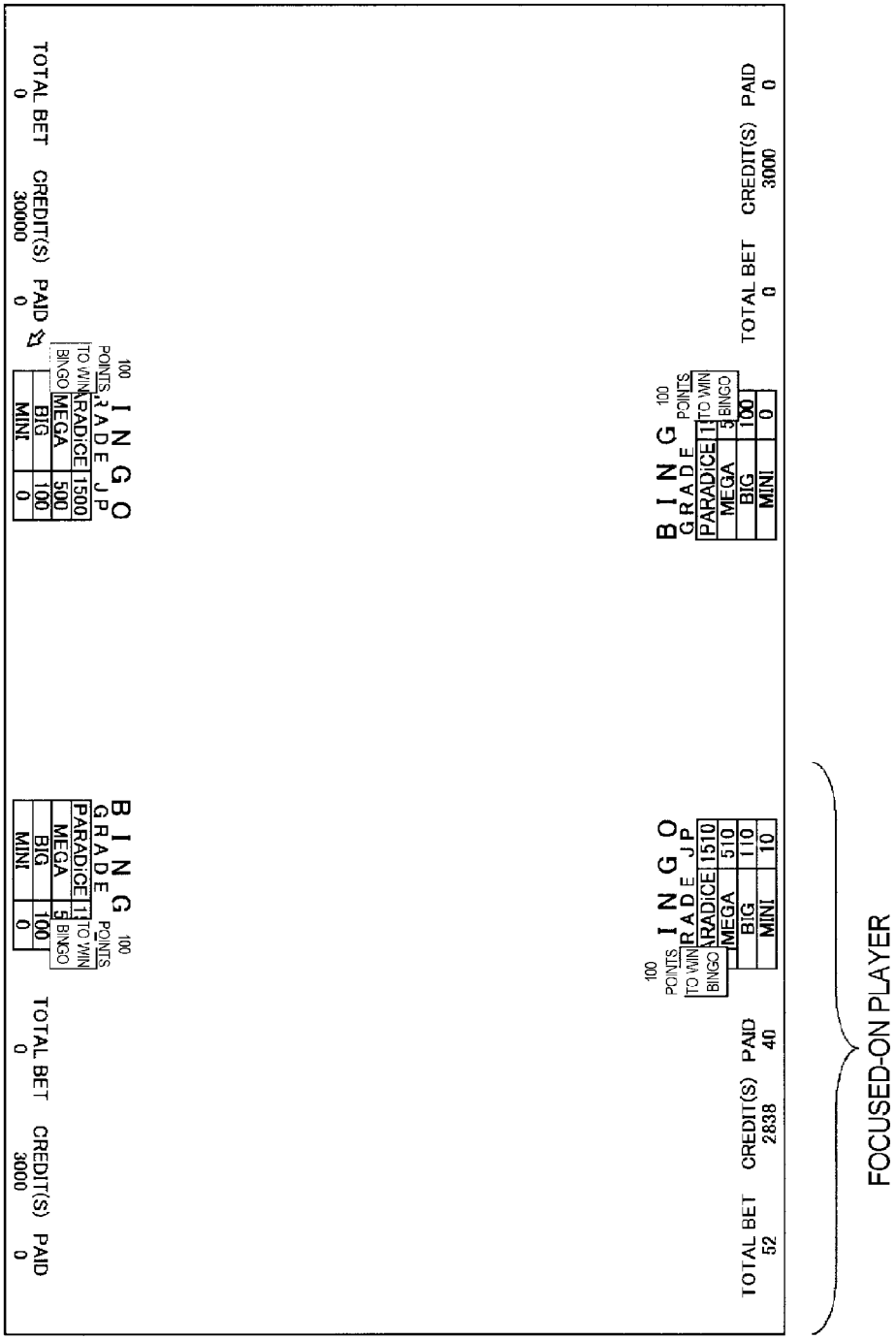
FIG. 10 is a diagram illustrating another example of a display screen of the game table display according to an embodiment of the invention.

(e) The odds acquired from the odds 104 for each betting target (FIG. 3B) based on the winning betting targets 123 (FIG. 3A) are subtracted from the sub game startup point 124 (FIG. 3A). FIG. 10 shows an example of a display screen in a state in which, regarding the lower left player, two betting targets with odds of "2" have won, so that the sub game startup point has been reduced by "4," resulting in "96."

Figure 11:
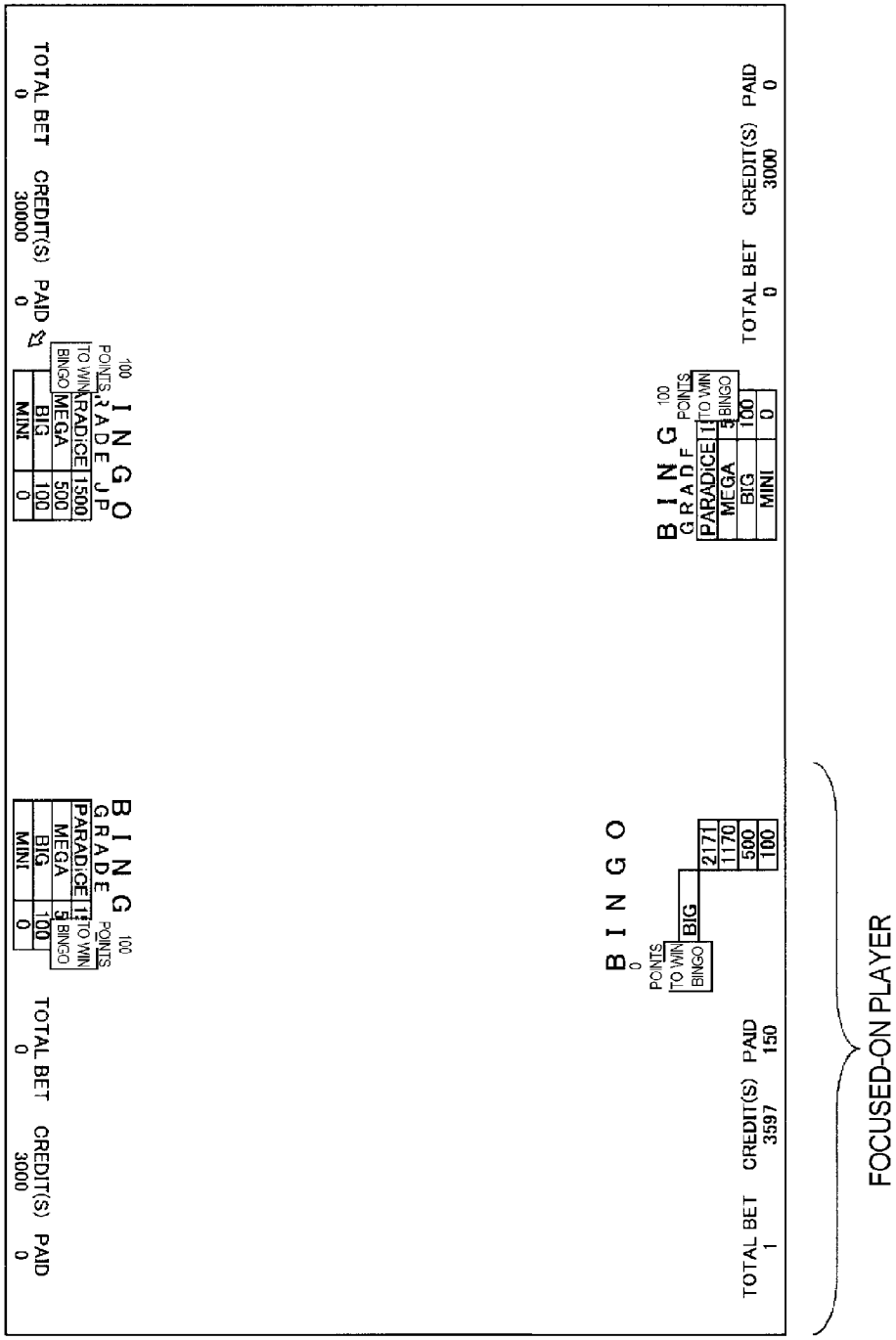
FIG. 11 is a diagram illustrating another example of a display screen of the game table display according to an embodiment of the invention.

Next, referring back to FIG. 4, in step S12, the main game controller 51 determines whether or not a sub game start condition has been satisfied. In the state seen in FIG. 10, the sub game startup point has not reached the sub game start condition "0"; when the sub game startup point reaches "0" by repeating the above-described main game process, the sub game start condition is satisfied. FIG. 11 shows an example of a display screen in a state in which the sub game start condition has been satisfied with the sub game startup point of the lower left player having reached "0."

Figure 12:
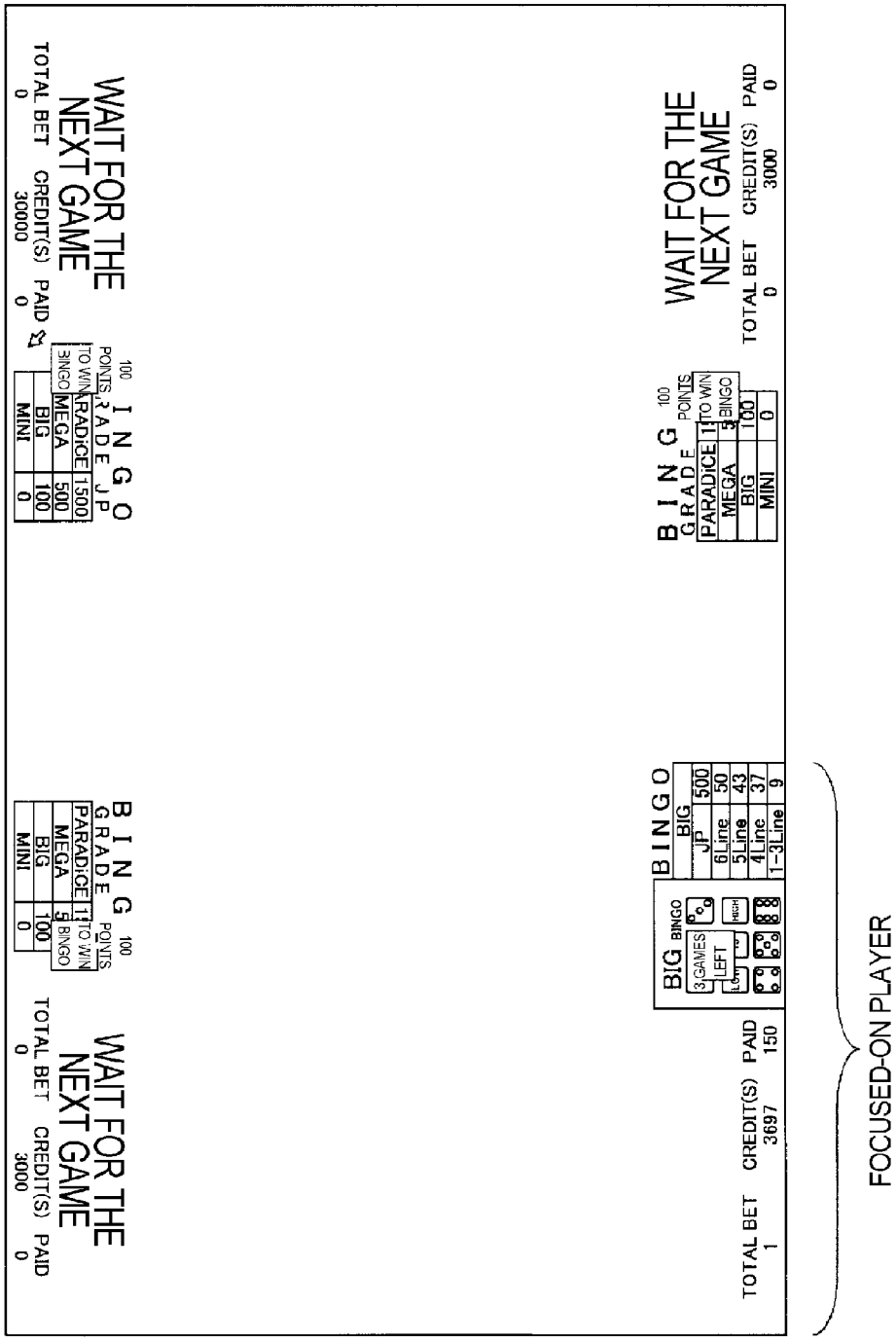
FIG. 12 is a diagram illustrating another example of a display screen of the game table display according to an embodiment of the invention.

Referring back to FIG. 4, if the main game controller 51 determines that a sub game start condition is satisfied (YES in step S12), in step S13, the sub game controller 52 then starts a sub game. That is, the rolled numbers of a die (either one rolled number may be employed, or multiple rolled numbers—regarding which it is sufficient for any one of such numbers to produce a match—may be employed) are assigned randomly to each of the squares (e.g., 3×3=9 squares), and a state is then produced in which, with such squares being displayed in place of the bars of a grade meter, rolled numbers in a dice game serving as the main game are waited for. FIG. 12 shows an example of a display screen in a state in which, regarding the lower left player, bingo-game squares are displayed, at a part where a grade meter was displayed, with the correspondence being shown between the number of winning lines and the allotments.

Referring back to FIG. 4, after the start of a sub game (step S13), the process returns to commencement of the acceptance of bets in the main game (step S1). If the main game controller 51 determines that a sub game start condition is not satisfied (NO in step S12), the process returns to commencement of the acceptance of bets in the main game while a sub game has not been started (step S1).

Figure 13:
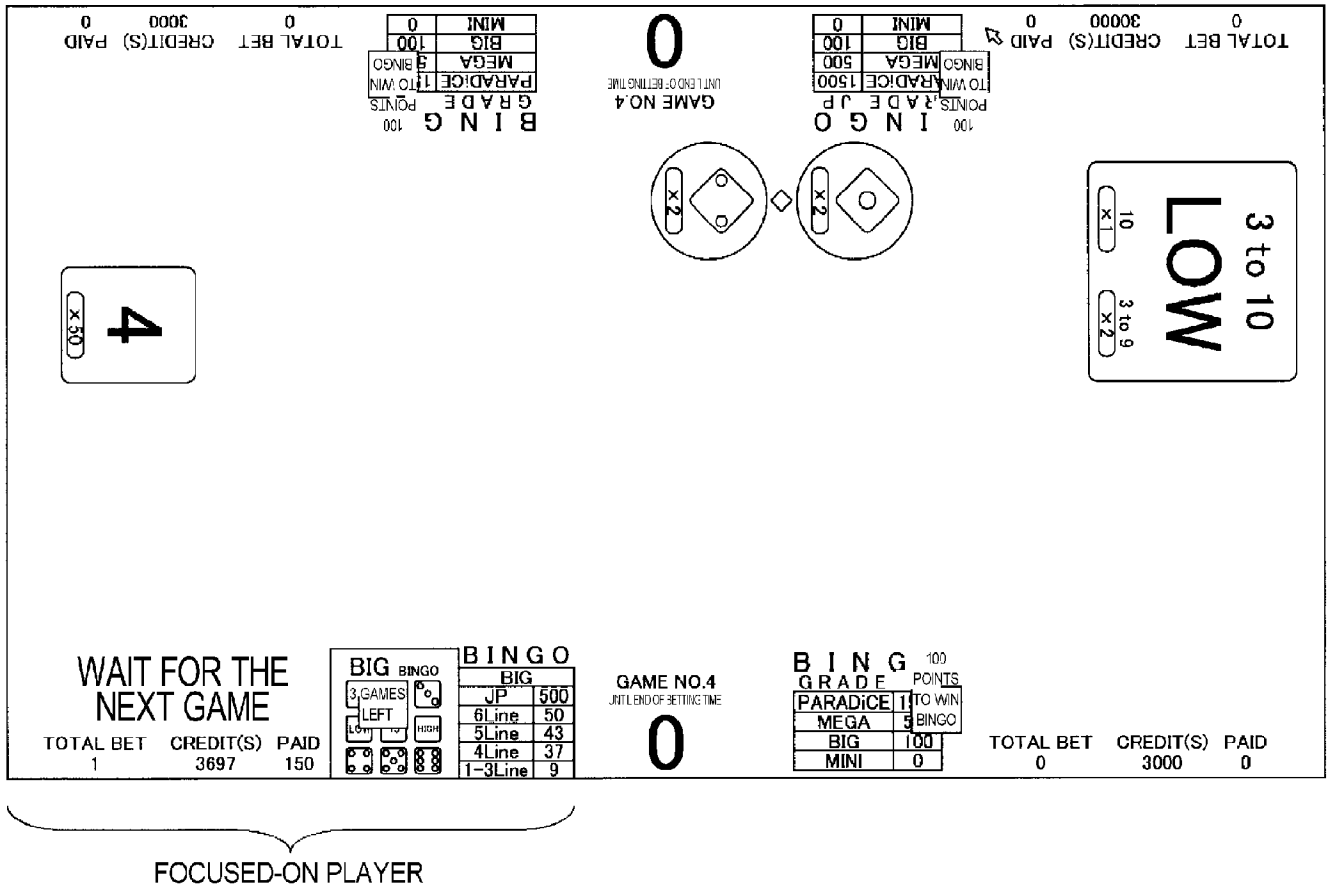
FIG. 13 is a diagram illustrating another example of a display screen of the game table display according to an embodiment of the invention.
Figure 14:
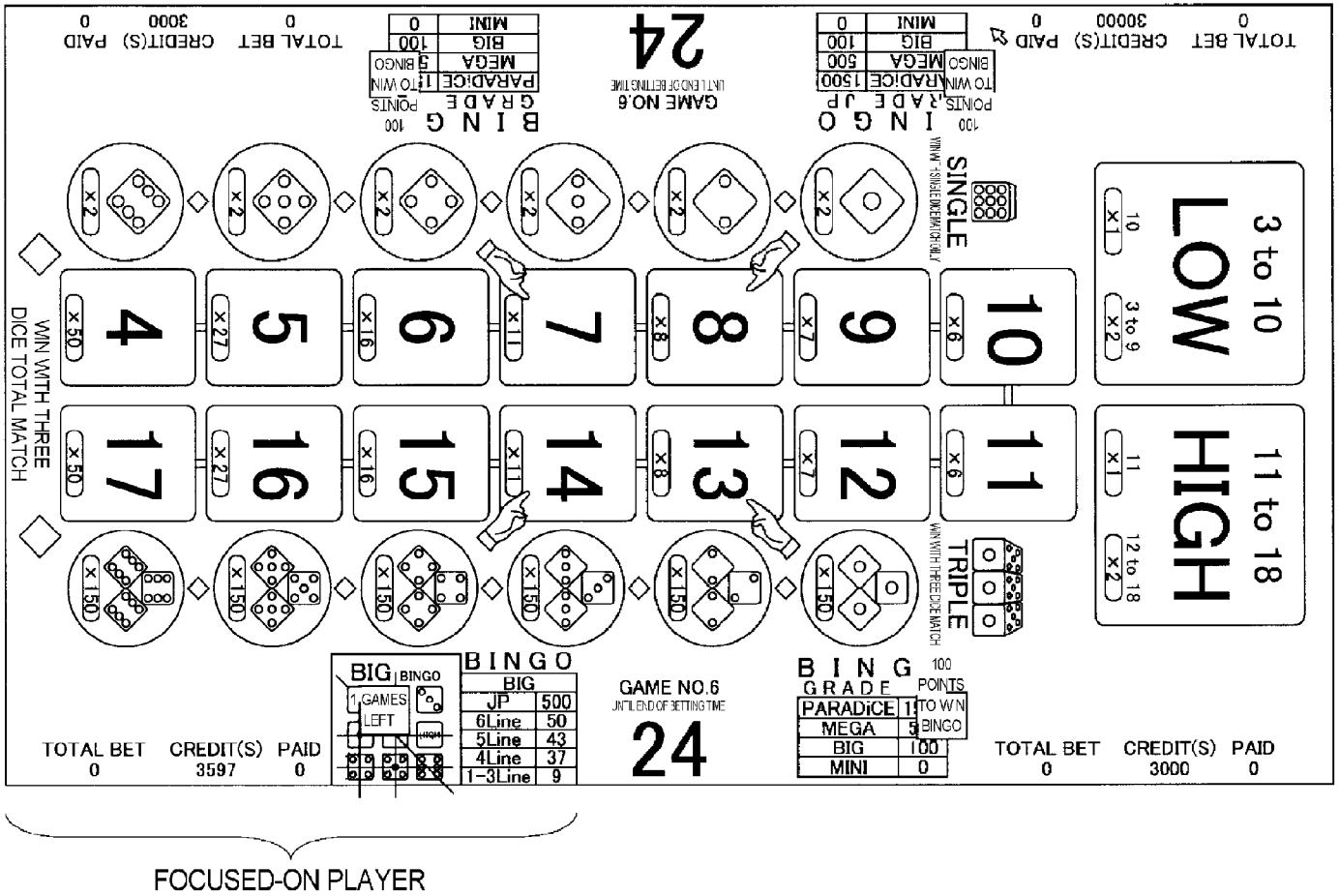
FIG. 14 is a diagram illustrating another example of a display screen of the game table display according to an embodiment of the invention.
Figure 15:
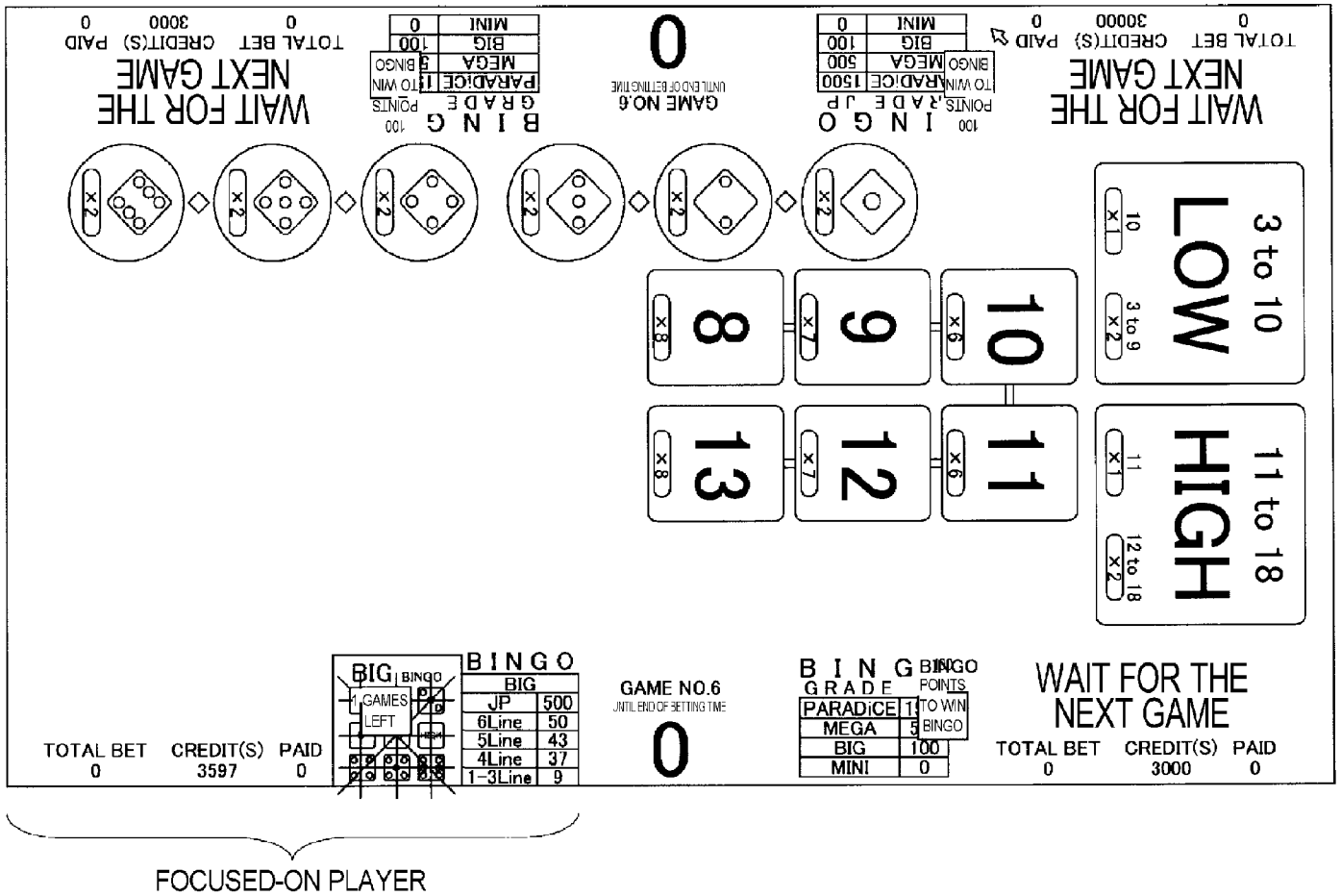
FIG. 15 is a diagram illustrating another example of a display screen of the game table display according to an embodiment of the invention.

If a sub game is started, in the subsequent step, if rolled numbers in the main game are fixed (step S7), it is then determined that the sub game is in execution (YES in step S8), and thus, such rolled numbers are reflected in the sub game in step S9. That is, when the rolled numbers assigned to the respective squares of the bingo game are compared with the rolled numbers in the main game, and such rolled numbers in the main game match any of the rolled numbers for the squares, the relevant square serves as a line component for a win (in general, an "occupied" "open" state). Then, if such three squares, as line components, are located vertically, horizontally or diagonally in a continuous manner, the continuous line serves as a winning line. FIG. 13 shows an example of a display screen in a state in which, regarding the sub game of the lower left player, three squares, the upper left corner, upper center and left center squares, are open. FIG. 14 shows an example of a display screen in a state in which, regarding the sub game of the lower left player, five winning lines have been formed. FIG. 15 shows an example of a display screen in a state in which, regarding the sub game of the lower left player, a jackpot (the formation of eight winning lines) has been achieved.

The sub game ends after being executed a predetermined number of times (the number of times comparisons are performed with the rolled numbers in the main game). An allotment is then provided in accordance with the number of winning lines that have been formed until the time point.

Further, when the sub game ends, the state of a grade meter returns to the initial state, in principle; the accumulated scale value in the middle of the previously determined present grade is carried over to the next sub game. Moreover, the excess over the maximum values of the jackpot values for the respective grades is also carried over to the next sub game.

As described above, the embodiments provide the following advantages.

(a) A value depending on the difference between a set payout ratio and a position payout ratio for a betting target is accumulated as a stake, and a sub game with a payout ratio of 1 (100%) is executed; thus, it is possible to have an actual payout ratio of an entire game apparatus converge to a desired set payout ratio even if the odds for such betting target are fixed. Therefore, the effort of an operator setting the odds for each betting target can be saved, it is also possible to prevent a comparison, which derives from the fact that the set payout ratio of an entire game apparatus can be expected from odds set for each betting target, from being made regarding the businesses with good/poor allotments. Further, even if the odds set for each of a plurality of betting targets have an inappropriate value inconsistent with the winning probability, because the actual payout ratio of an entire game apparatus will converge to the set payout ratio set by an operator, the game media can be paid out fairly, regardless of the odds for a betting target bet by a player.

(b) The stake accumulation state of a sub game is displayed by a grade meter, whereby a player can still be provided with a sense of expectation for such sub game.

(c) A sub game stake is accumulated separately as both a bet stake and an allotment stake, whereby such sub game stake can be increased even when no win has been gained, resulting in an increase of the player's enjoyability.

(d) The scale value of a grade meter is increased when a bet is made, and jackpot values are increased when an allotment is provided, by way of which an acceptable stake accumulation can be carried out.

(e) The increase of the scale value of a grade meter causes a shift to an upper grade, by way of which it becomes easy to understand the degree of stake accumulation by intuition.

(f) A sub game is executed with reference to a grade whose maximum value has been reached by the scale value of a grade meter at the start of the sub game, whereby it can be ensured that an accumulated stake is utilized as effectively as possible.

(g) The scale value kept in a grade meter at the end of a sub game and an excess over the maximum values of jackpot values is carried over to the next sub game, whereby it can be shown to a player that his/her stake has not been wasted.

(h) The odds for winning betting targets are subtracted from a point value that starts from a predetermined initial value, and a sub game commences when such point value becomes zero, by way of which it becomes easy for a player to understand the time when a sub game will commence.

(i) Odds for each of a plurality of betting targets are set such that a position payout ratio has a value lower than that of a set payout ratio, by way of which stake sharing can be performed effectively with respect to a sub game.

(j) When a plurality of odds is set for subdivided events of one betting target, a position payout ratio is calculated by performing an addition of the respective products of the winning probabilities for such subdivided events and the corresponding odds, whereby an appropriate stake calculation can be carried out.

All of the embodiments and conditional expressions contained in the specification are intended to be contributory, from an educational viewpoint, to the reader's understanding of the invention and the concept by the inventor for technological development, and limited interpretations should not be made based on such specifically described examples and conditions. Further, the configurations of such examples in the specification are not related to the indication of the merits and demerits of the invention. Although one or a plurality of embodiments has (have) been described in detail, it should be appreciated that various changes, alternatives and modifications may be made without departing from the gist and scope of the invention.

DESCRIPTION OF REFERENCE NUMERALS

1 Game apparatus
2 Operation casing
3 Game table display
4 Operation table
5 Operator
6 Medal slot
**6*a*** Medal detector
7 Operation table speaker
8 Medal discharge hopper
9 Medal outlet
10 Dice upward-blowing casing
11 Column
12 Ceiling
13 History display
14 Upward-blowing casing speaker
15 Base
16 Upward-blowing pipe
20 Game field
35 Stepping motor
36 DC axial-flow fan
46 Camera
47 Infrared LED
50 Control unit
51 Main game controller
52 Sub game controller
53 Upward-blowing controller
54 Rolled-number detection processor
55 Display controller
56 Sound controller
60 Storage unit
61 Game program
62 Control data

What is claimed is:

1. A game apparatus comprising:

an operation casing comprising a game table display;

a dice upward-blowing casing connected to the operating casing, the dice upward-blowing casing comprising a transparent pipe;

a fan disposed below the transparent pipe;

a camera;

an operator that receives a manual input of a bet by a player on a betting target among a plurality of betting targets for each of which odds indicating a winning allotment in a first game are set;

a storage unit that holds a set payout ratio; and a control unit that carries out actions comprising:

controlling the fan to blow the at least one die through the transparent pipe in a direction upward with respect to the game table display;

controlling the camera photograph an image of the at least one die detecting the number rolled on the die from the photographed image, displaying a plurality of squares for a second game on the game table display;

randomly assigning a number to each of the plurality of squares;

paying out a game medium in accordance with the detected number;

calculating a stake for the second game whose payout ratio is 1, taking into account, along with a number of bet game media, a difference between a position payout ratio, which serves as a winning allotment expectation value per unit of game media, for the betting target bet to which the bet of the manual input by the player corresponds, and the set payout ratio;

accumulating the calculated stake if a predetermined condition is satisfied, executing the second game by determining whether the detected number matches a randomly assigned number of at least one of the squares; and when the detected number is determined to match the randomly assigned number of at least one of the squares, visually indicating, within the plurality of displayed squares, the at least one square to be in an occupied state.

2. The game apparatus according to claim 1, wherein the control unit carries out further actions comprising:

calculating a first stake for the first game by multiplying the difference between the position payout ratio for the betting target bet on by the player and the set payout ratio held by the storage unit, by the number of bet game media and a bet stake-share-ratio; and when an allotment is provided in accordance with a drawing result, calculating a second stake for the second game by multiplying a value obtained by dividing, by a winning probability for the betting target, a difference between a position payout ratio for a winning betting target bet on by the player and the set payout ratio held by the storage unit, by the number of bet game media and an allotment stake-share-ratio.

3. The game apparatus according to claim 2, wherein the control unit carries out further actions comprising:

accumulating the calculated first stake as a scale value of a grade meter that indicates a stake accumulation state of the second game; and accumulating the calculated second stake as a jackpot value that indicates an allotment when a big win occurs in the second game.

4. The game apparatus according to claim 3, wherein the grade meter:

has a plurality of grades, causes a shift to an upper grade if the scale value reaches a maximum value set for each grade; and holds a jackpot value whose maximum value is specified for each grade.

5. The game apparatus according to claim 4, wherein the control unit carries out further actions comprising executing the second game with respect to a grade whose maximum value has been reached by the scale value at a start of the second game.

6. The game apparatus according to claim 5, wherein a scale value kept in the grade meter at an end of the second game is carried over to the next second game.

7. The game apparatus according to claim 5, wherein a jackpot value that has exceeded the maximum value of the jackpot value of the grade meter at an end of the second game is carried over to the next second game.

8. The game apparatus according to claim 1, wherein the control unit carries out further actions comprising subtracting odds for a winning betting target from a point value that starts from a predetermined initial value, and starting the second game when the point value becomes zero.

9. The game apparatus according to claim 1, wherein odds for a plurality of betting targets are set such that the position payout ratio has a value lower than that of the set payout ratio.

10. The game apparatus according to claim 1, wherein, when a plurality of odds is set for subdivided events of one betting target, the position payout ratio is calculated by performing an addition of products of winning probabilities for the subdivided events and corresponding odds.

11. A game apparatus comprising:

an operator that receives a manual input of a bet by a player on a betting target among a plurality of betting targets for each of which odds indicating a winning allotment in a first game are set;

a drawing unit that conducts a drawing for the first game with a physically operable means;

a read unit that reads a result of the drawing;

a transmitting unit that transmits a signal from the read unit;

an allotment unit that pays out a game medium in accordance with a drawing result of the drawing unit;

a storage unit that holds a set payout ratio targeted by the game apparatus;

a stake calculation unit that calculates a stake for a second game whose payout ratio is 1, taking into account, along with a number of bet game media, a difference between a position payout ratio, which serves as a winning allotment expectation value per unit of game media, for the betting target on by the player, and a set payout ratio held by the storage unit;

a stake accumulation unit that accumulates a stake calculated by the stake calculation unit; and a second game execution unit that, if a predetermined condition is satisfied, executes the second game based on a stake accumulated in the stake accumulation unit.

* * * * *